US006789973B2

(12) United States Patent
Marks

(10) Patent No.: US 6,789,973 B2
(45) Date of Patent: Sep. 14, 2004

(54) APPARATUS AND METHOD FOR APPLYING LIQUIDS TO A SURFACE

(76) Inventor: Ronald A. Marks, 2400 Olive St. #25, Bakersfield, CA (US) 93301

( * ) Notice: Subject to any disclaimer, the term of this patent is extended or adjusted under 35 U.S.C. 154(b) by 0 days.

(21) Appl. No.: 10/719,133

(22) Filed: Nov. 22, 2003

(65) Prior Publication Data

US 2004/0141796 A1 Jul. 22, 2004

Related U.S. Application Data

(63) Continuation-in-part of application No. 10/071,532, filed on Feb. 8, 2002, now abandoned.

(51) Int. Cl.[7] ..... B05C 1/00; B05C 17/025; B05C 17/03; B05C 17/035; B43K 8/20

(52) U.S. Cl. ..... 401/197; 401/147; 401/220

(58) Field of Search ..... 401/46, 123, 126, 401/136, 137, 144, 146–148, 150, 171, 173, 179, 196, 197, 208, 219, 220; 222/249; 239/447

(56) References Cited

U.S. PATENT DOCUMENTS 3,620,633 A * 11/1971 Charvoz ..... 401/147
5,254,108 A * 10/1993 Burrell et al. ..... 401/220
6,109,809 A * 8/2000 Pistis ..... 401/197

* cited by examiner

*Primary Examiner*—Tuan Nguyen
(74) *Attorney, Agent, or Firm*—James M. Duncan

(57) ABSTRACT

The present invention is directed to an apparatus and method for applying a liquid to a surface. One embodiment of the apparatus comprises a liquid roller comprising a roller member comprising a cylindrical body having a first side, a second side, an outer application surface and an inside surface. The inside surface comprises a continuous groove extending about the inside circumference. A follower rides in the groove, with one end of a piston arm is connected to the follower and another end of the connected to a piston enclosed within a cylinder. A liquid supply means is hydraulically connected to the cylinder by liquid conducing means. An axle extends axially through the center of the roller member. Liquid dispersion means disperse the liquid from the cylinder to the outer application surface as the roller member is rotated about the axle. A handle member is attached to the axle.

15 Claims, 3 Drawing Sheets

APPARATUS AND METHOD FOR APPLYING LIQUIDS TO A SURFACE

CROSS-REFERENCE TO RELATED APPLICATIONS

This is a continuation-in-part of U.S. application Ser. No. 10/071,532 filed on Feb. 8, 2002, now abandoned, to which the inventor claims domestic priority, and which are incorporated by reference herein.

BACKGROUND OF THE INVENTION

The present invention relates to an apparatus and method for applying a liquid to a surface. The use of rollers is known for delivery of paint, cleaning solutions, and various protective coatings to various surfaces, such as walls, automobile bodies and other structure to which one wishes to apply the aforementioned products. As is well known, the most general use of rollers for this purpose involves dipping the exterior surface of the roller, typically comprising an absorbent outer surface, into a pan of liquid and then lifting the roller from the pan and applying it to the surface to which the liquid is to be applied. However, as known by the users of this type of roller, the liquid often drips off of the roller onto either the user, the floor and/or other objects or surfaces which are not intended to have the liquid applied. Moreover, the repeated action of dipping the roller into the pan to obtain additional liquid can be tiring to the user, particularly if the user has to step down from a ladder or step-stool to dip the roller.

Various devices have been disclosed for delivery of a liquid to a roller, thereby eliminating the need to dip the roller into a pan. However, many of these devices are complicated, requiring a large number of parts. This characteristic makes the devices expensive to manufacture, and therefore costly to the consumer. The large number of parts can also make the devices prone to mechanical failure. The present invention addresses these needs.

SUMMARY OF THE INVENTION

The present invention is directed to an apparatus and method for applying a liquid to a surface.

One embodiment of the disclosed apparatus comprises a liquid roller comprising a roller member comprising a cylindrical body having a first side, a second side, an outer application surface and an inside surface. The inside surface comprises a continuous groove extending about the inside circumference. In one embodiment, the groove has a starting point adjacent to the first side, the groove trending toward the second side as it extends around the first half of the circumference and trending toward the first side as it extends around the second half of the circumference whereon the groove meets the starting point. A follower rides in the groove. A piston arm is connected to the follower. The piston arm is connected on its other end to a piston. A cylinder encloses the piston. A liquid supply means is hydraulically connected to the cylinder by liquid conducing means. Liquid dispersion means disperse the liquid from the cylinder to the outer application surface. An axle extends axially through the center of the roller member. A handle member is attached to the axle.

A method of applying a liquid to a surface is also disclosed utilizing the embodiments disclosed herein.

These and other features, aspects, and advantages of the present invention will become better understood with regard to the following description, appended claims, and accompanying drawings.

DETAILED DESCRIPTION OF THE EMBODIMENTS

Figure 1:
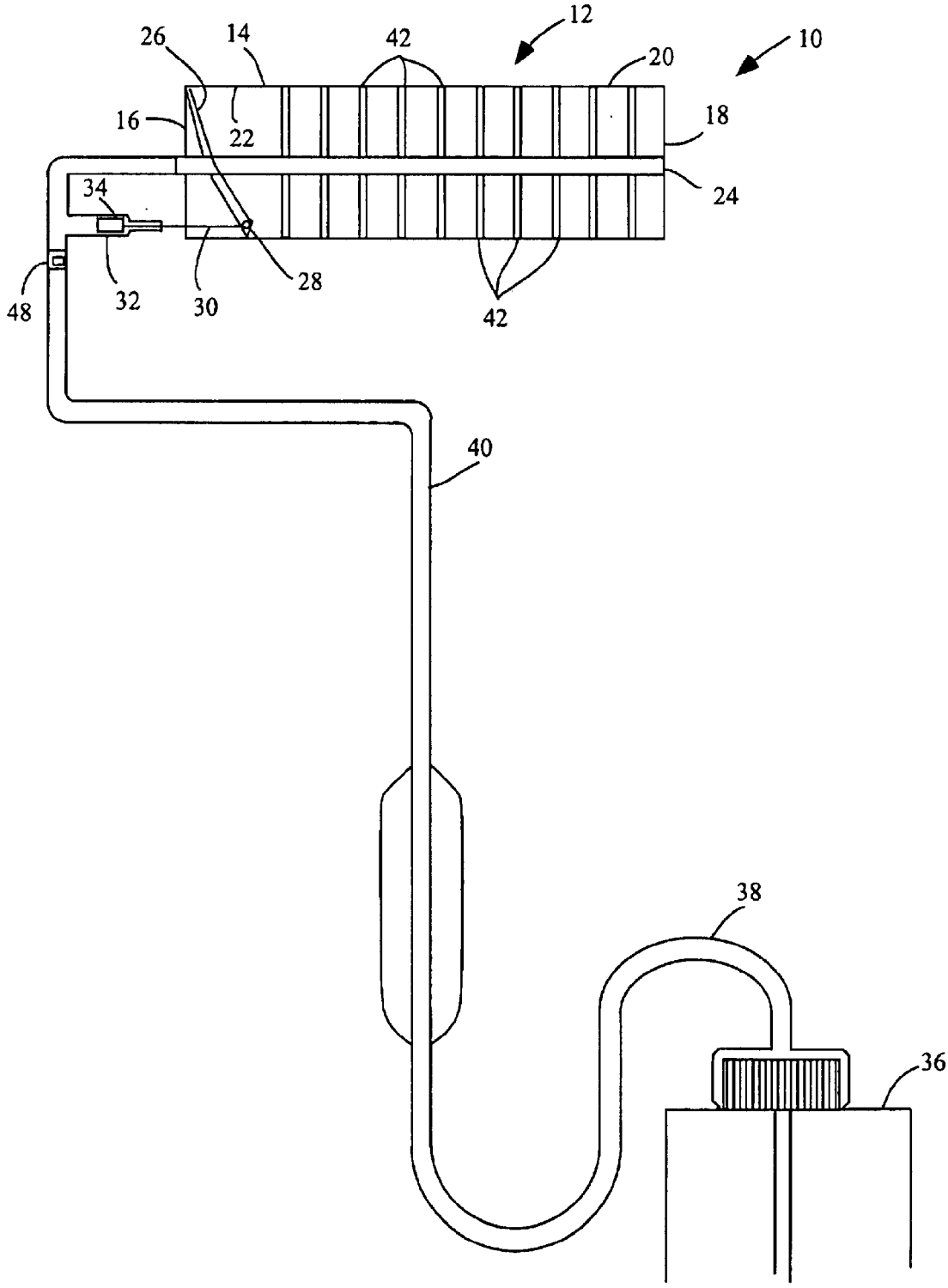
FIG. 1 is a schematic of a first embodiment of the disclosed invention.

Referring now specifically to the drawings, FIG. 1 shows a first embodiment 10 of the disclosed liquid roller. This embodiment comprises a roller member 12. The roller member 12 comprises a cylindrical body 14, which has having a first side 16 and a second side 18. The roller member 12 further comprises an outer application surface 20. This outer application surface 20 may be that typically used with paint rollers, made of an absorbent material. The roller member further comprises an inside surface 22. An axle 24 extends axially through the center of the roller member 12. The inside surface 22 of the roller has a continuous groove 26 which extends about the inside circumference of the roller member 12. A follower 28 extends into and rides along inside the continuous groove 26. Piston arm 30 is attached to follower 28. Piston 32 is attached to piston arm 30. Cylinder 34 encloses and houses piston 32.

Figure 3:
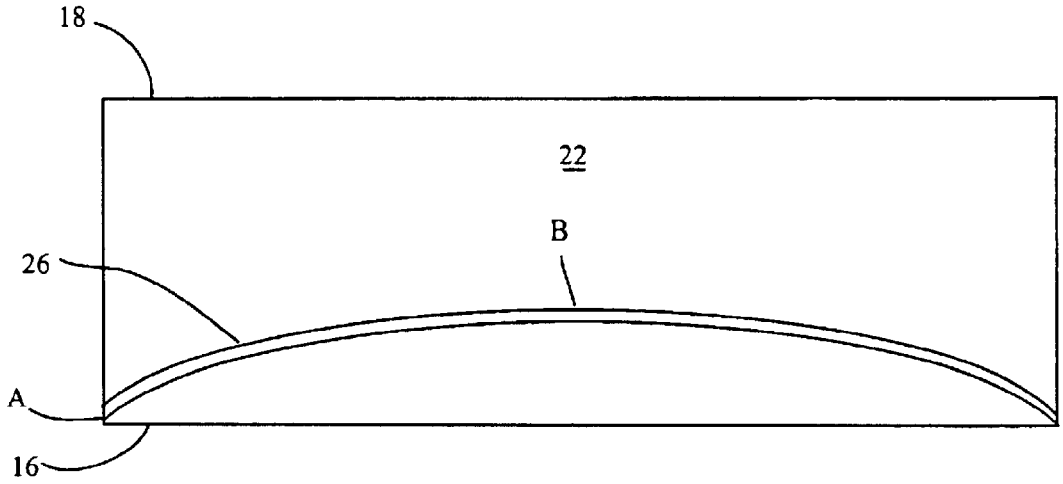
FIG. 3 is a plan view of the inside surface of one embodiment of the roller member.

As can be appreciated, continuous groove 26 serves to actuate piston 32 as the roller member 12 is rotated about axle 24. For example, FIG. 3 shows the inside surface of 22 of the roller member 12 in plan view. One variety of continuous groove 26 which may be used is one in which the groove has a starting point A adjacent to the first side 16. The continuous groove 26 trends toward the second side 18 as it extends around the first half of the circumference, reaching a maximum distance from first side 16 at point B. Continuous groove 26 trends back toward first side 16 as it extends around the second half of the circumference whereon the groove meets the starting point at point A. It is to be appreciated that with a continuous groove 26 as shown in FIG. 3, piston 32 will stroke one complete stroke for a single rotation of roller member 12, as follower 28 tracks the continuous groove.

Figure 4:
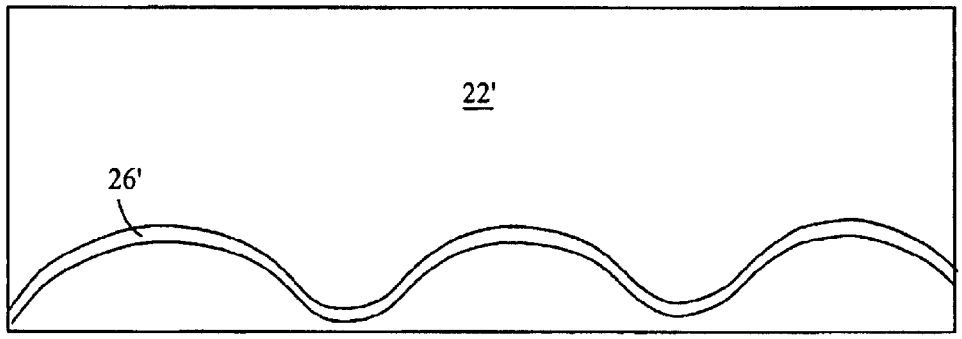
FIG. 4 is a plan view of the inside surface of another embodiment of the roller member.

A second embodiment of continuous groove 26' is shown in FIG. 4. In this embodiment, continuous groove 26' follows a sinusodial path around the inside surface 22'. This form of continuous curve will cause piston 32 to complete more than one stroke for a single rotation of roller member 12. It is to be appreciated that many different forms of continuous groove might be used in order to achieve the desired number of strokes of piston 32 per number of revolutions of roller member 12. Of course the number of strokes of piston 32 determines the volume of liquid which will be dispersed to outer application surface 20 as the roller member 12 is rolled across the surface to which the liquid is to be applied.

Figure 2:
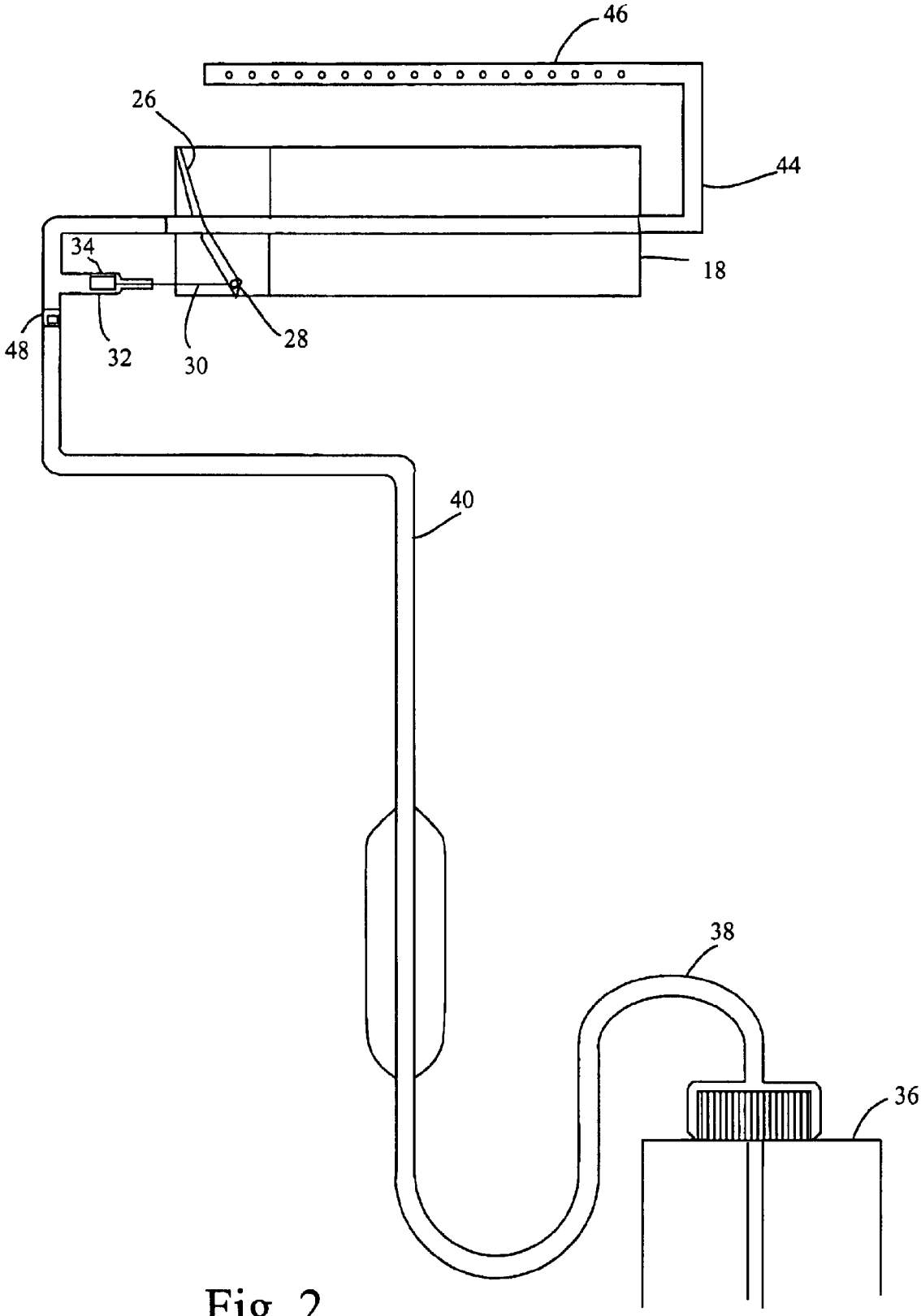
FIG. 2 is a schematic of a second embodiment of the disclosed invention.

Liquid supply means, such as container 36, contain the liquid to be applied. Liquid conducting means, such as tubing 38, hydraulically connect the cylinder 34 to the liquid supply means. Tubing 38 may be disposed within handle 40, which is attached to axle 24. The device comprises liquid dispersion means for dispersing the liquid from the cylinder 34 to the outer application surface 20. As shown in FIG. 1, the liquid dispersion means may comprise means for connecting the cylinder 34 to the axle 24. In this embodiment, the axle 24 comprises at least one conduit 42 extending to the outer application surface 20. Alternatively, as shown in FIG. 2, the liquid dispersion means may comprise means for connecting the cylinder 34 to the axle 24', where the axle 24' has an extension member 44 extending through the second side 18 of the roller member 12, the extension member extending over a portion of the outer application surface 20, the extension member having at least one opening 46 for dispersing liquid to the outer application surface.

Each of the embodiments of the disclosed apparatus may comprise check valve 48 to prevent liquid from being pumped back into the liquid supply means as the piston 32 strokes within cylinder 34.

A method of applying a liquid to a surface comprises the steps of first preparing the surface for application of the liquid. The desire liquid is placed within one of the embodiments of the liquid roller disclosed herein. The rolling member is then rolled against the surface, thereby dispersing the liquid onto the surface.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following claims.

What is claimed is:

1. A liquid roller comprising:

a roller member comprising a cylindrical body having a first side, a second side, an outer application surface and an inside surface, the inside surface comprising a continuous groove extending about the inside circumference, the groove having a starting point adjacent to the first side, the groove trending toward the second side as it extends around the first half of the circumference and trending toward the first side as it extends around the second half of the circumference whereon the groove meets the starting point;

a follower riding in the groove;

a piston arm connected to the follower;

a piston connected to the piston arm;

a cylinder enclosing the piston;

a liquid supply means;

liquid conducting means hydraulically connecting the cylinder to the liquid supply means;

liquid dispersion means for dispersing the liquid from the cylinder to the outer application surface;

an axle extending axially through the center of the roller member; and a handle member attached to the axle.

2. The liquid roller of claim 1 wherein the liquid conducting means further comprises a check valve.

3. The liquid roller of claim 1 wherein the fluid dispersion means comprises means for connecting the cylinder to the axle, the axle comprising at least one conduit extending to the outer application surface.

4. The liquid roller of claim 1 wherein the fluid dispersion means comprises means for connecting the cylinder to the axle, the axle having an extension member extending through the second side of the roller member, the extension member extending over a portion of the outer application surface, the extension member having at least one opening for dispersing liquid to the outer application surface.

5. The liquid roller of claim 1 wherein the liquid supply means comprises a bottle.

6. The liquid roller of claim 5 wherein the liquid conducting means comprises flexible tubing extending from the bottle through the handle member to the cylinder.

7. The liquid roller of claim 6 wherein the flexible tubing comprises a check valve.

8. A liquid roller comprising:

a roller member comprising a cylindrical body having a first side, a second side, an outer application surface and an inside surface, the inside surface comprising a continuous groove extending about the inside circumference, the groove having a starting point adjacent to the first side, the groove trending in a sinusodial path along the inside circumference, trending back and forth between the first side and the second side as it extends around the circumference;

a follower riding in the groove;

a piston arm connected to the follower;

a piston connected to the piston arm;

a cylinder enclosing the piston;

a liquid supply means;

liquid conducting means hydraulically connecting the cylinder to the liquid supply means;

liquid dispersion means for dispersing the liquid from the cylinder to the outer application surface;

an axle extending axially through the center of the roller member; and a handle member attached to the axle.

9. The liquid roller of claim 8 wherein the liquid conducting means further comprises a check valve.

10. The liquid roller of claim 8 wherein the fluid dispersion means comprises means for connecting the cylinder to the axle, the axle comprising at least one conduit extending to the outer application surface.

11. The liquid roller of claim 8 wherein the fluid dispersion means comprises means for connecting the cylinder to the axle, the axle having an extension member extending through the second side of the roller member, the extension member extending over a portion of the outer application surface, the extension member having at least one opening for dispersing liquid to the outer application surface.

12. The liquid roller of claim 8 wherein the liquid supply means comprises a bottle.

13. The liquid roller of claim 12 wherein the liquid conducting means comprises flexible tubing extending from the bottle through the handle member to the cylinder.

14. The liquid roller of claim 13 wherein the flexible tubing comprises a check valve.

15. A method of applying a liquid to a surface comprising the steps of:

(a) preparing the surface for application of the liquid;

(b) placing a liquid within a liquid roller, the liquid roller comprising: (i) a roller member comprising a cylindrical body having a first side, a second side, an outer application surface and an inside surface, the inside surface comprising a continuous groove extending about the inside circumference, the groove having a starting point adjacent to the first side, the groove trending toward the second side as it extends around the first half of the circumference and trending toward the first side as it extends around the second half of the circumference whereon the groove meets the starting point; (ii) a follower riding in the groove; (iii) a piston arm connected to the follower; (iv) a piston connected to the piston arm; (v) a cylinder enclosing the piston; (vi) a liquid supply means; (vii) liquid conducting means hydraulically connecting the cylinder to the liquid supply means; (viii) liquid dispersion means for dispersing the liquid from the cylinder to the outer application surface; (ix) an axle extending axially through the center of the roller member; and (x) a handle member attached to the axle; and (c) rolling the roller member against the surface.

* * * * *